US005469582A

United States Patent [19]

Livingston

[11] Patent Number: 5,469,582

[45] Date of Patent: Nov. 28, 1995

[54] BREAST FEEDING COVER

[76] Inventor: Diane Livingston, 102 Bannister Avenue, Regina, Saskatchewan S4R 5K9, Canada

[21] Appl. No.: 336,226

[22] Filed: Nov. 7, 1994

[51] Int. Cl.[6] ..... A41D 1/00; A41D 1/20; A41D 1/22

[52] U.S. Cl. ..... 2/104; 2/48; 2/49.1

[58] Field of Search ..... 2/49.1.49.2, 49.3, 2/49.4, 49.5, 46, 48, 50, 51, 52, 69, 75, 80, 104, 105, 106, 88, 174, 2; 5/494

[56] References Cited

U.S. PATENT DOCUMENTS

| | | | |
|---|---|---|---|
| 2,517,357 | 8/1950 | Schlegel | 2/49.2 |
| 4,031,566 | 6/1977 | Johnson | 2/104 |
| 4,106,122 | 8/1978 | Dodd | 2/104 |
| 4,651,349 | 3/1987 | Heiler | 2/104 |
| 5,259,068 | 11/1993 | Carroll | 2/104 |

*Primary Examiner*—Jeanette E. Chapman
*Attorney, Agent, or Firm*—Adrian D. Battison; Murray E. Thrift

[57] ABSTRACT

To allow mothers to breast feed their babies discretely in public, this article, called a breast feeding cover, covers a mother and her baby and has a viewing window so that mother can see the baby nursing (feeding) but no one else can. The breast feeding cover fits over one shoulder and attaches around the mother's neck. A small semi-circular viewing window protrudes outward from the front panel of the breast feeding cover just above the breast so that the mother can see the baby nursing while the rest of the baby is covered. The breast feeding cover is reversed when the mother is nursing the baby on the opposite side. The viewing window is created from a stiff ribbon to ensure the pocket juts out adequately to allow the mother to view the baby. The viewing window is also reversed by pushing the stiff ribbon to the opposite side of the breast feeding cover.

3 Claims, 2 Drawing Sheets

BREAST FEEDING COVER

This invention relates to a cover for use by a nursing mother while breast feeding a baby.

Mothers with new babies are encouraged in books, by health care staff and by provincial and federal governments to breast feed (nurse) their babies. In the company of others or in public places this can be difficult and many mothers either go to a private room or put a blanket over their shoulder and the baby. The latter is difficult because the mother cannot see the baby unless she removes the blanket thereby defeating the purpose of the blanket. In addition, blankets are awkward and often fall off the shoulder or do not cover adequately. This can make the whole nursing procedure frustrating and embarrassing for the mother and others present.

SUMMARY OF THE INVENTION

I have found that these problems can be overcome by using an article I call a breast feeding cover. It fits snugly over one shoulder and around the neck so that the cover does not fall down. A panel of lightweight reversible fabric suspended from a yoke covers the mother's front down to approximately her waist, thereby ensuring that the mother and baby are covered. A viewing window is built into the article between the yoke and skirt allowing the mother to see the baby, position the baby on the breast and see the baby breast feeding while the breast feeding cover is secluding the baby and the breast feeding from the view of others. The cover is reversed and placed on the opposite shoulder when breast feeding on the opposite side. This invention will allow nursing mothers to feel more at ease and comfortable while breast feeding their babies in the company of others.

In use the panel or skirt is draped over the chest of the mother including the breast and over the baby and the opening means between the yoke and skirt defines the viewing window at a position on the skirt above the breast, the opening means including bottom edge of the yoke across a top of the opening means and an upper edge of the skirt across a bottom of the opening means and means supporting the upper edge of the skirt outwardly of the yoke so that the mother can see through the viewing window by looking downwardly while the breast and the baby remain covered from view by others in a generally horizontal direction.

Preferably the supporting means comprises a stiffening member at the lower edge which lies within a sleeve at the lower edge.

Preferably the opening means lie substantially in a common horizontal plane thus preventing the viewing of others in the horizontal direction.

Preferably the panel or skirt is held in place by a yoke engaging over at least one shoulder of the mother with the panel attached to a front edge of the yoke so as to depend therefrom.

Preferably the yoke is shaped to engage over one shoulder only of the mother and includes strap or means for engaging around the neck of the mother on a side of the neck opposite to the one shoulder and the cover is reversible by turning inside out, that is an inside surface of the fabric is moved to become an outside surface of the fabric, so that the cover can be used over one shoulder and then can be converted to engage over the other shoulder. Also the stiffening member is reversible by being manually pushed through the opening between the upper edge of the skirt and the bottom edge of the yoke to project outwardly from the chest of the mother when the cover is reversed.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
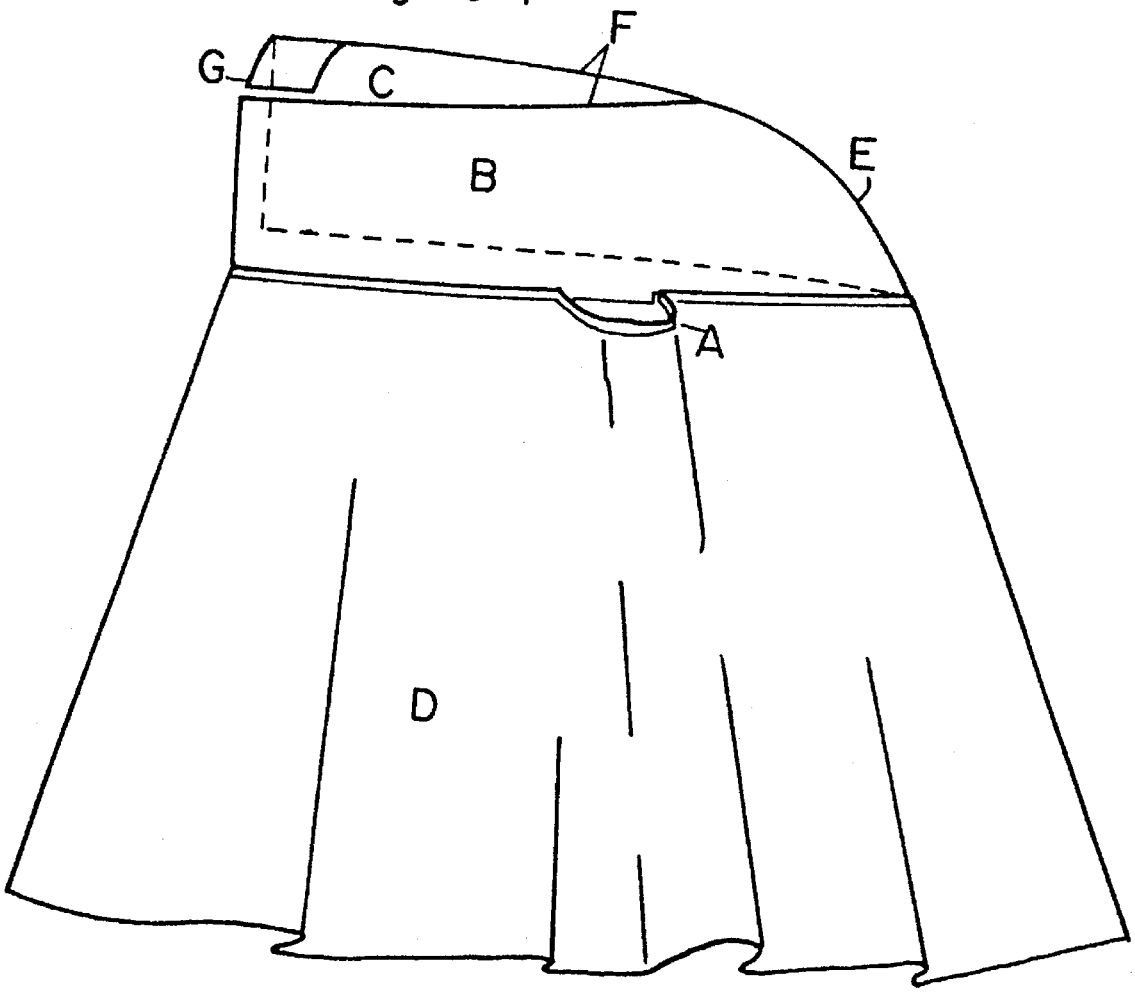
FIG. 1 is a front view of the breast feeding cover.
Figure 2:
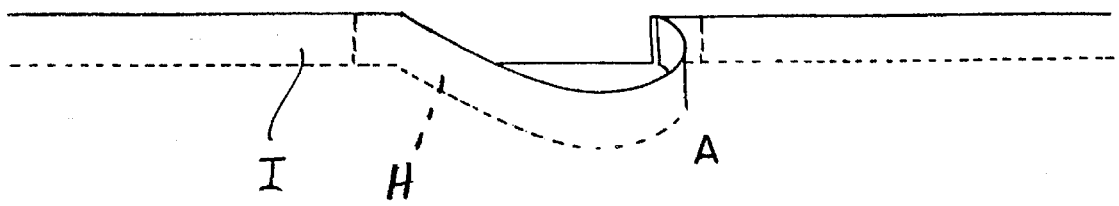
FIG. 2 is a close-up front view of the cover showing the viewing window.
Figure 3:
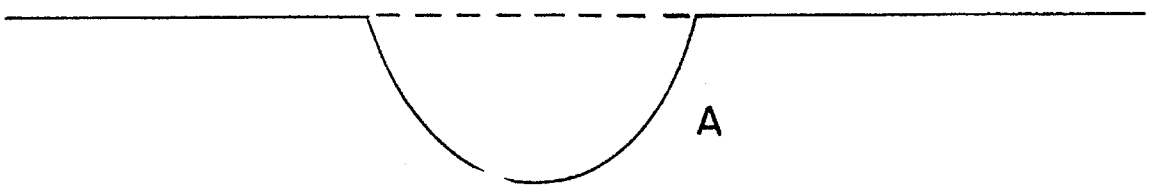
FIG. 3 is a top view of the viewing window.

The breast feeding cover is constructed using three primary components: the yoke B and C; the front panel D and the viewing window A. The yoke is shaped to fit over one shoulder and extend horizontally across the upper chest and back area. The yoke fastens around the neck F on the opposite shoulder with Velcro or other fasteners G. The yoke may be reinforced with interfacing to hold the shape more readily. The front panel D is a piece of reversible fabric which attaches to the front of the yoke. It is designed to be suspended from the yoke to cover the chest area of the mother including the breast of the mother and child, A strip H of material called boning or other such o stiff material is sewn into a sleeve section I of the top of the front panel to be used to create the viewing window A.

When the front panel is attached to the yoke, the boning is pushed into a semi-circular formation such that it protrudes from the yoke in the same generally horizontal plane as the upper edge of the opening and creates the horizontal viewing window. The lower edge of the opening including the sleeve is longer than an upper edge of the opening such that the upper edge lies flat against the chest of the mother while the lower edge projects outwardly from the chest Holes may be placed in the front panel or lace or other material may be used on parts of the front panel to allow for better air circulation.

The distinguishing features of this invention are:

1. The viewing window allows the mother to see and "work" with baby out of sight of others.
2. The yoke fits over the shoulder and across the neck and back to ensure that the cover does not fall down during feeding.
3. The cover and viewing window are reversible for feeding on the opposite side.

Variations to this article could include:

1. A two-sided cover that fits over both shoulders with a viewing window above each breast.
2. Clothing which incorporates the viewing window into the design.
3. A breast feeding cover or piece of clothing which uses collapsible viewing windows.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A cover for use by a nursing mother while breast feeding a baby comprising a yoke shaped and arranged to engage over one shoulder only of the mother and including strap means for engaging around the neck of the mother on a side of the neck opposite to the one shoulder, a skirt attached to a front edge of the yoke so as to depend therefrom so that in use the skirt is draped over the chest of the mother including the breast and over the baby, the yoke and skirt being reversible by turning inside out so that an inside surface of the fabric is moved to become an outside surface of the fabric and so that the cover when reversed can be used on an opposite shoulder of the mother, opening means between the skirt and the yoke defining a viewing window at a position above the breast, the opening means including a bottom edge of the yoke across a top of the opening means and an upper edge of the skirt across a bottom of the opening means, the upper edge of the skirt and the bottom edge of the yoke lying substantially in a common horizontal plane and a stiffening member supporting the upper edge of the skirt outwardly of the bottom edge of the yoke to a side of the skirt away from the chest of the mother so that the mother can see through the viewing window by looking downwardly while the breast and the baby remain covered from view by others in a generally horizontal direction, the stiffening member being reversible from said one side of the skirt by manually pushing through the opening means between the bottom edge of the yoke and the upper edge of the skirt to an opposite side of the skirt so as to project outwardly from the chest of the mother when the cover is reversed and used on the opposite shoulder of the mother.

2. The cover as defined in claim 1 wherein the stiffening member lies within a sleeve at the upper edge of the skirt.

3. The cover as defined in claim 1 wherein the upper edge of the skirt is longer than the lower edge of the yoke such that the lower edge of the yoke lies flat against the chest of the mother while the upper edge of the skirt projects outwardly from the chest.

* * * * *